US007390271B2

(12) United States Patent
Yamamoto

(10) Patent No.: US 7,390,271 B2
(45) Date of Patent: Jun. 24, 2008

(54) GOLF CLUB HEAD

(75) Inventor: Akio Yamamoto, Kobe (JP)

(73) Assignee: SRI Sports Ltd., Kobe (JP)

( * ) Notice: Subject to any disclaimer, the term of this patent is extended or adjusted under 35 U.S.C. 154(b) by 82 days.

(21) Appl. No.: 11/313,795

(22) Filed: Dec. 22, 2005

(65) Prior Publication Data

US 2006/0172818 A1 Aug. 3, 2006

(30) Foreign Application Priority Data

Jan. 28, 2005 (JP) ..... 2005-021535

(51) Int. Cl.
*A63B 53/04* (2006.01)

(52) U.S. Cl. ..... 473/345; 473/346

(58) Field of Classification Search ..... 473/345–346, 473/332, 344; D21/752
See application file for complete search history.

(56) References Cited

U.S. PATENT DOCUMENTS 1,548,867 A * 8/1925 Burke ..... 473/344
D161,790 S * 1/1951 Sappington ..... D21/745
4,432,549 A * 2/1984 Zebelean ..... 473/346
4,438,931 A * 3/1984 Motomiya ..... 473/346
4,511,145 A * 4/1985 Schmidt ..... 473/346
5,000,454 A * 3/1991 Soda ..... 473/346
5,295,689 A * 3/1994 Lundberg ..... 473/346
5,451,058 A * 9/1995 Price et al. ..... 473/340
5,676,606 A * 10/1997 Schaeffer et al. ..... 473/340
5,720,674 A * 2/1998 Galy ..... 473/345
5,735,754 A * 4/1998 Antonious ..... 473/328
5,851,159 A * 12/1998 Burrows ..... 473/345
6,309,311 B1 * 10/2001 Lu ..... 473/332
6,558,271 B1 * 5/2003 Beach et al. ..... 473/327
6,641,490 B2 * 11/2003 Ellemor ..... 473/326
6,783,465 B2 * 8/2004 Matsunaga ..... 473/329
6,852,038 B2 * 2/2005 Yabu ..... 473/224
6,939,247 B1 * 9/2005 Schweigert et al. ..... 473/314
2004/0198532 A1 * 10/2004 Caldwell et al. ..... 473/345
2005/0049081 A1 * 3/2005 Boone ..... 473/346
2005/0119070 A1 * 6/2005 Kumamoto ..... 473/345

FOREIGN PATENT DOCUMENTS

JP 7-313636 A 12/1995
JP 2003-93559 A 4/2003

* cited by examiner

*Primary Examiner*—Sebastiano Passaniti
(74) *Attorney, Agent, or Firm*—Birch, Stewart, Kolasch & Birch, LLP

(57) ABSTRACT

A hollow golf club head is provided. A sole portion is provided with at least one rib extended from a toe side to a heel side. The rib is curved in a manner that a toe-side end and a heel-side end of the rib are located closer to a face side than a central part of the rib.

10 Claims, 7 Drawing Sheets

GOLF CLUB HEAD

BACKGROUND OF THE INVENTION

The present invention relates to a golf club head including a hollow portion therein.

Conventionally, importance has been attached to an impact sound of the golf club head. Particularly, the golf club head including the hollow portion therein is apt to produce a relatively great impact sound and hence, the quality of the sound is quite important. The current trend, in particular, is to reduce the thicknesses of individual parts of the head which is becoming larger and larger. Such a head tends to produce a low and loud impact sound, which is unpopular among most golfers. Therefore, it is quite important for the hollow golf club heads to produce an impact sound of proper volume and quality.

In this connection, there have been disclosed techniques for improving the impact sound. Japanese Unexamined Patent Publication No. 93559/2003 discloses a golf club head which includes a rib laid on an inside surface of a sole in a direction orthogonal to a face surface, such as to allow for the increase of the head volume relative to the head weight, thereby affording a comfortable hit feel as well as a comfortable impact sound.

Although not directed to the improvement of the impact sound, a technique of laying the ribs on the sole is proposed in Japanese Unexamined Patent Publication No. 313636/1995. The publication discloses a hollow golf club head which includes ridges formed on an outside surface of the sole as extended in the direction orthogonal to the face surface. The ridges are provided for the purpose of implementing a low centroid design and offering easy swing through.

Unfortunately, the above prior-art techniques have failed to fully improve the volume or quality of the impact sound. The vibrations of the sole upon impact with a ball are particularly great at an area near the face (an area adjacent to the face surface striking the ball). In the golf club heads of the above patent publications, the rib on the sole is extended from the area near the face surface toward a back side along a face-back direction. Therefore, the rib excessively suppresses the vibrations at the area near the face surface, so that the impact sound is excessively decreased in volume.

As a solution to this problem, it may contemplated to lay out the rib as follows. The rib is extended in a toe-heel direction rather than in the face-back direction and is located at place, for example, near the center with respect to the face-back direction rather than in the vicinity of the face. It is found, however, that this lay-out design cannot improve a low impact sound arising from a rib-free part of the sole although the rib is provided on the sole. The reason behind this fact is thought that the rib extended in the toe-heel direction and disposed near the center with respect to the face-back direction is located at a loop of sole vibrations produced at impact with the ball, thus acting to increase weight at the vibration loop so as to decrease the frequency of the vibrations. It is generally thought that the rib provided on the sole acts to increase the rigidity of the sole and to increase the frequency of the vibrations of the sole. However, the rib formed at the center with respect to the face-back direction as extended in the toe-heel direction has a relatively small effect to increase the frequency of the vibrations of the sole at impact with the ball. Rather, the rib has a relatively great effect to decrease the frequency of the vibrations because of the increased weight at the vibration loop.

SUMMARY OF THE INVENTION

In view of the foregoing, the invention has an object to provide to a hollow golf club head capable of improving the volume and quality of the impact sound.

The golf club head according to the invention is a hollow golf club head wherein a sole portion is provided with at least one rib extended from a toe side to a heel side and wherein the rib is curved in a manner that a toe-side end and a heel-side end of the rib are located closer to a face side than a central part of the rib.

In this case, the impact sound is not excessively decreased in volume because the vibrations of the sole portion are not excessively suppressed in contrast to the case where the rib is extended in the face-back direction. Furthermore, the impact sound is not excessively lowered in tone pitch because the frequency of the vibrations is not decreased due to the rib weight concentrated on the loop of vibrations, which is encountered in the case where the rib is linearly extended in the toe-heel direction. As a result, the impact sound may have favorable tone pitch and volume.

Provided that a toe-heel width of the sole portion is A(mm), a face-back width of the rib defined between a point thereof closest to the face side and a rearmost part thereof is B(mm), and a toe-heel width between a toe-side end of the sole portion and the rearmost part of the rib is C(mm), the above head may preferably be configured such that B(mm) is in the range of 20 mm to 60 mm, that (B/A) is in the range of 0.2 to 0.5 and that (C/A) is in the range of 0.3 to 0.7.

A region of the sole portion which is mainly involved in the vibrations at impact with the ball extends from the rib toward the face side. If B(mm) is too small, the region extending from the rib toward the face side is too small and hence, the impact sound produced by the vibrations of the sole portion tends to be excessively decreased in volume. Therefore, B(mm) is more preferably 25 mm or more and even more preferably 30 mm or more. If B(mm) is too great, the region extending from the rib toward the face side is too large and hence, the impact sound produced by the vibrations of the sole portion tends to be excessively increased in volume and lowered in tone pitch. Therefore, B(mm) is more preferably 50 mm or less and even more preferably 40 mm or less.

If (B/A) is too small, B(mm) becomes too small and hence, the impact sound tends to be excessively decreased in volume, as described above. Furthermore, the sole portion has too great a toe-heel width A(mm) relative to B(mm) and hence, the impact sound tends to be excessively increased in tone pitch. Therefore, (B/A) is more preferably 0.25 or more and even more preferably 0.3 or more. If (B/A) is too great, on the other hand, B(mm) becomes too great and hence, the impact sound tends to be excessively increased in volume and lowered in tone pitch, as described above. Furthermore, the sole portion has too small a toe-heel width A(mm) relative to B(mm) and hence, the impact sound tends to be excessively lowered in tone pitch. Therefore, (B/A) is more preferably 0.45 or less and even more preferably 0.4 or less.

If (C/A) is too much greater or smaller than 0.5, the sole region extending from the rib toward the face side is too small and hence, the impact sound produced by the vibrations of the sole tends to be excessively decreased in volume. Therefore, the lower limit of (C/A) is more preferably 0.4 or more and particularly preferably 0.45 or more. On the other hand, the upper limit of (C/A) is more preferably 0.6 or less and particularly preferably 0.55 or less.

As to the face-back width B(mm) of the rib defined between its point closest to the face side and the rearmost part thereof, a measurement reference position for the width B(mm) at the rearmost part rb of the rib is defined by a face-side edge of the rearmost part rb.

In a case where a boundary between the sole portion and the other portions (face portion, side portion and the like) is obscure, the boundary may be defined as follows. As seen in section of the head taken on a plane passing through the center of gravity of the head and perpendicular to a horizontal plane when the head is placed on the horizontal plane at predetermined real loft angle and lie angle, the boundary is located at one of the points that defines the smallest curvature radius, the points forming a head outside contour line portion near the boundary of the sole portion.

The toe-heel direction and the face-back direction may be defined as follows. In the standard state where the head is placed on the horizontal plane at the predetermined real loft angle and lie angle, the face-back direction is defined by an intersection between a vertical plane including a perpendicular line from the center of gravity of the head to the face surface (the line interconnecting the center of gravity of the head and a sweet spot) and the horizontal plane. In the above standard state, the toe-heel direction is defined by a direction parallel to the horizontal plane and perpendicular to the above face-back direction.

It is preferred that a width of the rib is 3 mm or more whereas a thickness of the rib is 1.5 or more times the sole thickness determined at the other parts than the rib.

If the rib width is too small, the effect of providing the rib is lessened and the impact sound tends to be excessively increased in volume and lowered in tone pitch. Therefore, the rib width is more preferably 5 mm or more and particularly preferably 7 mm or more. However, if the rib width is too great, the sole is excessively increased in rigidity so that the impact sound tends to be excessively decreased in volume. Hence, the upper limit of the rib width is preferably 15 mm or less, more preferably 12 mm or less and particularly preferably 10 mm or less.

If the rib thickness is too great, the effect of providing the rib is lessened so that the impact sound tends to be excessively increased in volume and lowered in tone pitch. Therefore, the rib thickness is more preferably 1.7 or more times the sole thickness determined at the other parts then the rib, and even more preferably 1.9 or more times. It is noted however that if the rib thickness is too great, the sole is excessively increased in rigidity so that the impact sound tends to be excessively decreased in volume. Therefore, the upper limit of the rib thickness is preferably not more than 3.0 times the sole thickness determined at the other parts than the rib, more preferably not more than 2.5 times, and particularly preferably not more than 2.0 times.

The sole thickness determined at the other parts than the rib means a mean thickness of the thicknesses determined at the parts of the sole portion except for the rib. The rib thickness means a thickness combining a thickness of the sole portion at its part formed with the rib and a thickness of the rib itself (or a height of the rib).

The rib divides the sole portion into two or more regions. One of the divided regions, that is the closest to the face side, may preferably have an area of 50% to 80% of the overall area of the sole portion. If this area percentage is too small, the region of the sole portion which is mainly involved in the vibrations is so small that the impact sound produced by the vibrations of the sole portion may be excessively decreased in volume. Therefore, this area percentage is more preferably 55% or more, and particularly preferably 60% or more. If the area percentage is too great, on the other hand, the region of the sole portion which is mainly involved in the vibrations is so large that the impact sound produced by the vibrations of the sole portion may be excessively increased in volume and lowered in tone pitch. Therefore, this area percentage is more preferably 75% or less and particularly preferably 70% or less.

The above golf club head may preferably be constructed such that a head volume is in the range of 380 to 470 cc and a head weight is in the range of 170 to 210 g.

By limiting the head weight to the above range, the above head may afford an optimum club balance when used as a so-called driver head (W#1). From this point of view, a more preferred head weight may have a lower limit of 175 g or more and even more preferably of 180 g or more, and an upper limit of 205 g or less and even more preferably of 200 g or less.

If the head volume is too small, the hollow portion tends to be decreased while the individual parts of the head tend to be increased in thickness. This may lead to an excessively decreased impact sound, or a lessened effect of the invention. Therefore, the head volume is more preferably 400 cc or more and particularly preferably 420 cc or more. If the head volume is too great, the head may suffer an insufficient strength. Therefore, the head volume is more preferably 460 cc or less and particularly preferably 450 cc or less.

DETAILED DESCRIPTION

A preferred embodiment of the present invention will hereinbelow be described with reference to the accompanying drawings.

Figure 1:
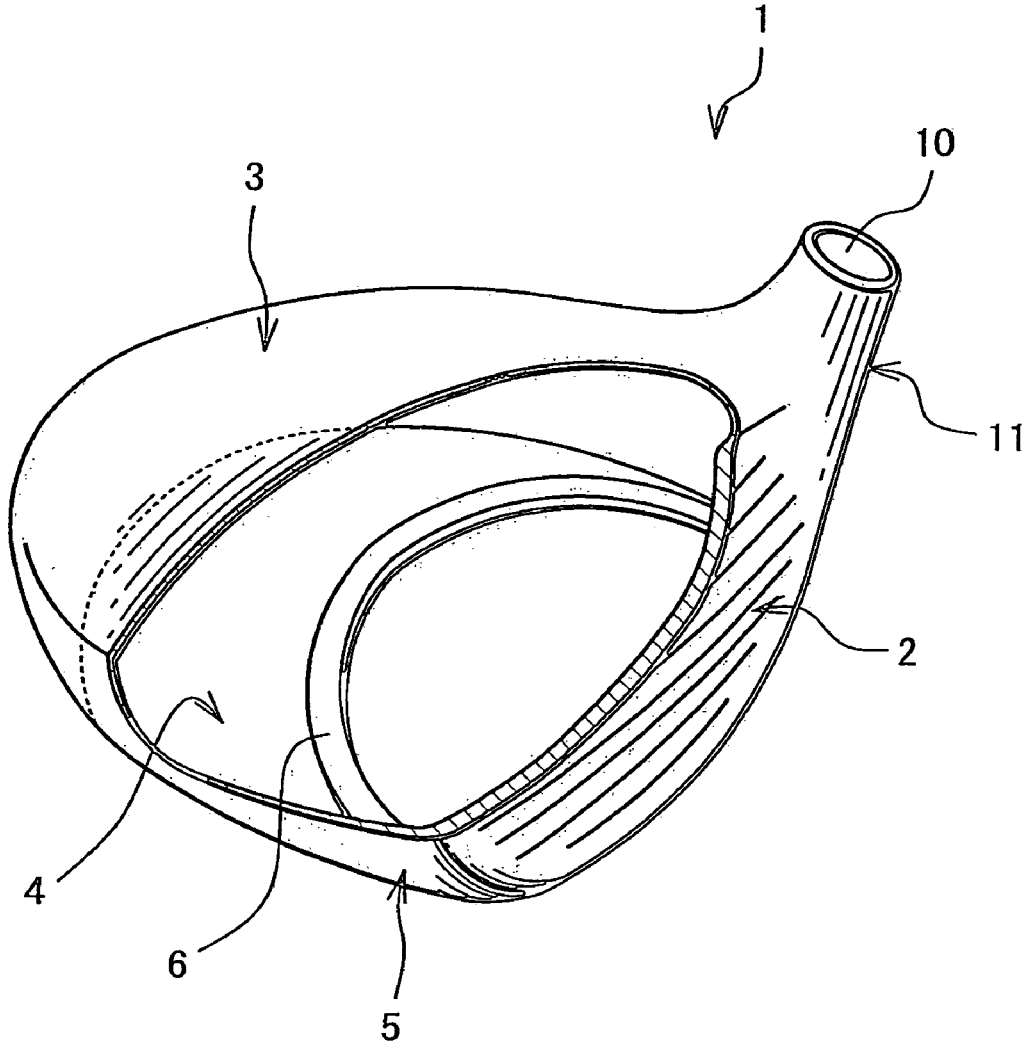
FIG. 1 is a partially cut-away perspective view showing a golf club head according to one embodiment of the present invention.

FIG. 1 is a perspective view showing a wood-type golf club head (hereinafter, simply referred to as "head") according to one embodiment of the present invention. In FIG. 1, an outer shell of the head is partially cut away for exposing an interior of the head.

The head 1 is a metallic golf club head including a hollow portion. The head includes: a face portion 2 on which the head contacts a ball when striking the ball; a crown portion 3 constituting an upper side of the head 1 as extending from an upper edge of the face portion 2 to a head back side; a sole portion 4 constituting a bottom of the head 1 as extending from a lower edge of the face portion 2 to the head back side; and a side portion 5 extended between the crown portion 3 and the sole portion 4 and excluding the face portion 2. The head 1 has a hollow interior, whereas an outer shell of the head 1 is defined by the face portion 2, crown portion 3, sole portion 4 and side portion 5 which have predetermined thicknesses. The head 1 is formed with a hosel portion 11 on a heel side thereof, the hosel portion including a shaft hole 10, to which a shaft is insertedly bonded. A major part of the hosel portion 11 is disposed within the head 1.

Figure 2:
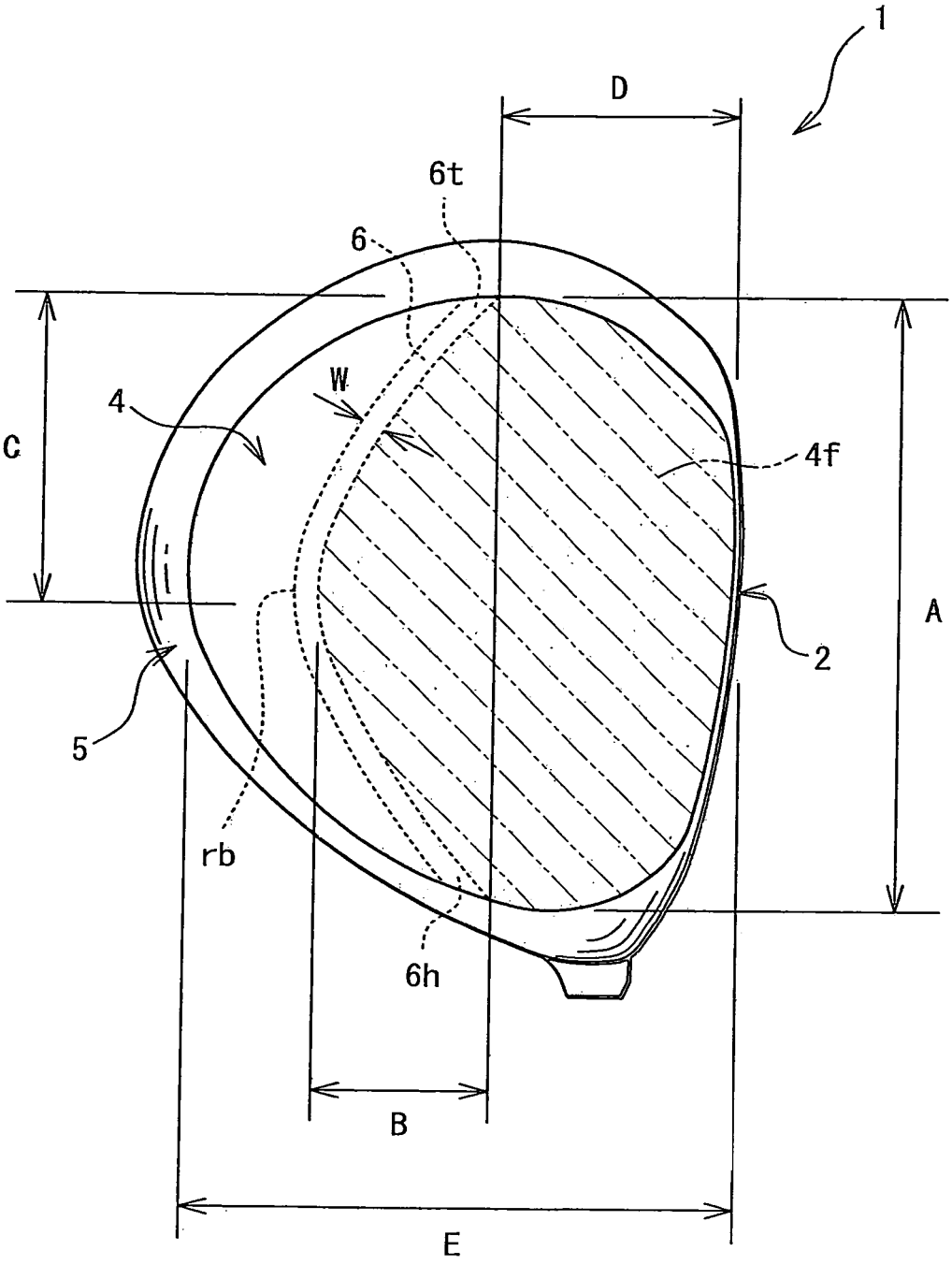
FIG. 2 is a view of the head of FIG. 1 (and heads of Examples 1 to 4) as seen from a sole side.

FIG. 2 is a view of the head 1 as seen from the sole portion 4. In the figure, a rib 6 disposed on an inside surface of the sole portion 4 is indicated by broken lines. As shown in FIG. 1 and FIG. 2, the rib (thick rib) 6 substantially curved in a bow is disposed on the inside surface of the sole portion 4. There is provided one rib 6. The rib 6 is curved in a manner that a toe-side end 6*t* and a heel-side end 6*h* of the rib 6 are closer to a face side than a central part of the rib 6 (the central part is away from the heel-side end 6*h* and the toe-side end 6*t* toward the center with respect to the toe-heel direction). It is noted that the rib 6 is not limited to the curved shape as illustrated by the embodiment but may have a bent shape. Furthermore, as shown in FIG. 2, the rib 6 according to the embodiment is so curved as to protrude toward the back side. A rearmost part rb defining the farthest back portion of the rib 6 is located substantially centrally of the sole portion 4 with respect to the toe-heel direction. Although the rib 6 of the embodiment has a rectangular sectional shape, the sectional shape is not particularly limited and may include a semi-circular shape, a trapezoidal shape and the like.

The rib 6 is provided in a manner to traverse the sole portion 4. Specifically, the rib 6 is extended from a toe-side edge to a heel-side edge of the sole portion 4, dividing the sole portion 4 into two regions (see FIG. 2). Furthermore, the rib 6 has its heel-side end 6*h* and toe-side end 6*t* located at positions which substantially correspond to each other with respect to the face-back direction.

Provided that a toe-heel width (maximum width) of the sole portion 4 is A(mm), a face-back width of the rib 6 defined between a point thereof closest to the face side and the rearmost part rb thereof is B(mm), and a toe-heel width between the toe-side end of the sole portion 4 and the rearmost part of the rib is C(mm), as shown in FIG. 2, B(mm) is in the range of 20 mm to 60 mm; (B/A) is in the range of 0.2 to 0.5; and (C/A) is in the range of 0.3 to 0.7.

When the head 1 strikes the ball, the individual parts of the head 1 are vibrated to produce an impact sound. The vibrations mainly involving the sole portion 4 are properly adjusted by providing the rib 6, so that the volume and quality (tone pitch) of the impact sound may be improved. Specifically, the rib 6 formed according to the above specifications does not excessively suppress the vibrations at the sole portion in contrast to a case where the rib 6 is extended in the face-back direction. Hence, the impact sound is not excessively decreased in volume. Furthermore, the impact sound is not excessively lowered in tone pitch because the frequency of the vibrations is not decreased due to rib weight concentrated on a loop of the vibrations, which is encountered in a case where the rib is linearly extended in the toe-heel direction. Therefore, the impact sound may have favorable tone pitch and volume. A vibration mode of the sole portion 4, a main consideration herein, is that of a vibration (outside surface primary bending vibration) wherein vibration nodes are formed in the vicinities of a face-side end and a back-side end of the sole portion 4, whereas a vibration loop is formed at the center of the sole portion 4 with respect to the face-back direction. In the case of the rib extended in the face-back direction, the rib excessively increases flexural rigidity of the sole portion with respect to a bending direction during the outside surface primary bending vibration. Therefore, the outside surface primary bending vibration is excessively suppressed so that the impact sound tends to be excessively decreased in volume. In the case of the rib linearly extended along the toe-heel direction, the rib has a small influence on the flexural rigidity of the sole portion with respect to the bending direction during the outside surface primary bending vibration. However, the rib weight concentrates on the loop of the vibrations so that the impact sound tends to be excessively lowered tone pitch.

In the sole portion 4, a region 4*f* (indicated by chain double-dashed lines in FIG. 2) extending from the rib 6 to the face side is mainly involved in the vibrations associated with the impact with the ball. If B(mm) is too small, the region 4*f* extending from the rib 6 to the face side is so small that the impact sound produced by the vibrations of the sole portion 4 tends to be excessively decreased in volume. If B(mm) is too great, on the other hand, the region 4*f* extending from the rib to the face side is so large that the impact sound produced by the vibrations of the sole portion 4 tends to be excessively increased in volume and lowered in tone pitch. It is therefore preferred to limit B(mm) to the aforementioned numerical range.

If (B/A) is too small, B(mm) becomes too small and hence, the impact sound tends to be excessively decreased in volume, as described above. Furthermore, the toe-heel width A(mm) of the sole portion is too much greater than B(mm) and hence, the impact sound tends to be excessively increased in tone pitch. If (B/A) is too great, on the other hand, B(mm) becomes too great and hence, the impact sound tends to be excessively increased in volume and lowered in tone pitch, as described above. Furthermore, the toe-heel width A(mm) of the sole portion is too much smaller than B(mm) and hence, the impact sound tends to be excessively lowered in tone pitch. It is therefore preferred to limit the value of (B/A) to the aforementioned numerical range.

If (C/A) is too much greater or smaller than 0.5, the position of the rearmost part rb of the rib 6 is shifted from the toe-heel center of the sole portion 4 toward the toe side or the heel side. Accordingly, the region 4*f* extending from the rib 6 to the face side tends to be decreased in the area. Since an impact point tends to be located in proximity of a face center, a neighborhood of the toe-heel center of the region 4*f*, in particular, is more prone to the vibrations. As the rearmost part rb of the rib 6 is shifted farther away from the toe-heel center toward the toe or heel side, the region 4*f* is correspondingly decreased in the area of the neighborhood of the toe-heel center thereof. Therefore, in the case where (C/A) is too much greater or smaller than 0.5, the impact sound produced by the vibrations of the sole portion tends to be excessively decreased in volume. It is therefore preferred to limit the value of (C/A) to the aforementioned numerical range.

A rib width W is defined to be 3 mm or more. A rib thickness is defined to be 1.5 or more times the sole thickness determined at the other parts than the rib 6. The rib 6 divides the sole portion 4 into two or more regions, as described above. Out of the regions so divided, the region 4*f* located on the face side has an area of 50% to 80% of the overall area of the sole portion 4.

A face-back width D(mm) of the rib 6 defined between a point thereof closest to the face side and the face-side end of the sole portion 4 (see FIG. 2) may preferably be in the following range. If D(mm) is too small, the region 4*f* extending from the rib 6 to the face side is so small that the impact sound produced by the vibrations of the sole portion 4 tends to be excessively decreased in volume. Therefore, D(mm) is preferably 20 mm or more, more preferably 25 mm or more and even more preferably 30 mm or more. If D(mm) is too great, the region 4*f* extending from the rib 6 to the face side is so large that the impact sound produced by the vibrations of the sole portion 4 tends to be excessively increased in volume and lowered in tone pitch. Therefore, D(mm) is preferably 50 mm or less, more preferably 45 mm or less and even more preferably 40 mm or less.

A face-back length E(mm) of the sole portion 4 (see FIG. 2) may preferably be in the following range. If E(mm) is too small, the aforementioned outside surface primary bending vibration of the sole portion 4 is decreased and hence, the effect of the present invention tends to be lessened. Therefore, E(mm) is preferably 75 mm or more, more preferably 80 mm or more and even more preferably 85 mm or more. However, the increase of E(mm) is limited to a certain extent in order to attain a sufficient head strength with maintaining a proper head weight. Therefore, E(mm) is preferably 105 mm or less, more preferably 100 mm or less and particularly preferably 95 mm or less.

While the number of ribs 6 is not particularly limited, the provision of too many ribs leads to an excessive increase of the rigidity of the sole portion 4 and to an impact sound excessively decreased in volume. It is therefore preferred to provide three or less ribs. While one or more ribs 6 may be provided, it is most preferred to provide a single rib. This is because the aforesaid region 4*f* which is mainly involved in the vibrations of the sole portion 4 may be defined by a single rib 6 and because a plural number of ribs results in an increased rib weight, which tends to restrict freedom in designing the head.

As to a head material, the whole body of the head may be formed from a metal. Otherwise, the head may partially include a non-metal member. The non-metal member usable in this case may be exemplified by CFRP (Carbon Fiber Reinforced Plastic) and the like. However, it is preferred to form the sole portion from a metal even in the case where the head partially includes the non-metal member. Where the sole portion is formed from a metal, the sole portion is involved in greater vibrations at impact with the ball as compared with a case where the sole portion includes the non-metal member. Hence, the impact sound arising from the sole portion has a relatively great volume. Accordingly, the sole portion formed from the metal increases the need of the present invention and also enhances the effect of the present invention even further.

The area of the sole portion (the overall area of the sole portion) is preferably 55 $cm^2$ or more, more preferably 60 $cm^2$ or more and even more preferably 65 $cm^2$ or more. If this area is too small, the vibrations of the sole portion may be excessively decreased, resulting in too small an impact sound. The area of the sole portion is preferably 85 $cm^2$ or less, more preferably 80 $cm^2$ or less and even more preferably 75 $cm^2$ or less. If this area is too large, the vibrations of the sole portion may be excessively increased so that the impact sound may be excessively increased in volume and lowered in tone pitch.

The thickness (mean value) of the sole portion as determined at the other parts than the rib is preferably 1.0 mm or more, more preferably 1.1 mm or more and even more preferably 1.2 mm or more. If this thickness is too small, the vibrations of the sole portion may be excessively increased, resulting in an impact sound excessively great in volume and low in tone pitch. The thickness (mean value) of the sole portion as determined at the other parts than the rib is preferably 1.8 mm or less, more preferably 1.7 mm or less and even more preferably 1.6 mm or less. If this thickness is too great, the vibrations of the sole portion may be excessively decreased, resulting in an impact sound excessively decreased in volume.

A method of forming the rib is not particularly limited. The rib may be formed integrally with the sole. Alternatively, the rib may be formed separately from the sole portion and welded thereto. However, the number of manufacture steps is increased in the case where the rib is formed separately from the sole portion and welded thereto. When the rib is welded to the sole portion, weld beads may be built up on the sole portion, so that the sole portion may become too heavy. It is therefore particularly preferred to form the rib and the sole in one piece. Examples of the method of forming the sole integrated with the rib include lost wax precision casting, forging, hot or cold pressing and the like. Examples of a metal for forming the sole portion include titanium alloys (6Al—4V titanium, 15V—3Cr—3Al—3Sn titanium, 15Mo—5Zr—3Al titanium, 13V—11Cr—3Al titanium and etc.), pure titanium, stainless steel, marageing steels, aluminum alloys, magnesium alloys and the like.

The rib may be provided on an outside surface of the sole portion or on the inside surface thereof as illustrated by the above embodiment. However, it is preferred to provide the rib on the inside surface of the sole portion as suggested by the above embodiment because such a sole affords a smoother swing-through (the sole encounters less resistance when touching ground on its outside surface). What is more, such a sole is easier to polish.

EXAMPLES AND COMPARATIVE EXAMPLES

The impact sound was evaluated by way of Examples 1 to 6 and Comparative Examples 1 to 3.

In order to verify the effect of ribs, all the examples (Examples 1 to 6 and Comparative Examples 1 to 3) conformed to common specifications but for specifications of the ribs. That is, all the examples used heads of the same configuration except for the rib disposed on the inside surface of the sole portion. The head had a thickness distribution in which a face thickness was 2.9 mm (a uniform thickness of the overall face portion), a crown thickness was 0.8 mm (a uniform thickness of the overall crown portion), and a side thickness was 0.8 mm (a uniform thickness of the overall side portion). All the examples defined a head volume to be 430 cc, a head weight to be 190 g and a face-back length of the sole portion (the width E in FIG. 2) to be 90 mm. Each of the heads was assembled with a common shaft and grip. The face portion of each head was formed by forging a sheet material of 6Al—4V titanium. The other portions than the face portion, which include the rib on the inside surface of the sole portion, were formed in one piece by forging the 6Al—4V titanium sheet material.

Figure 3:
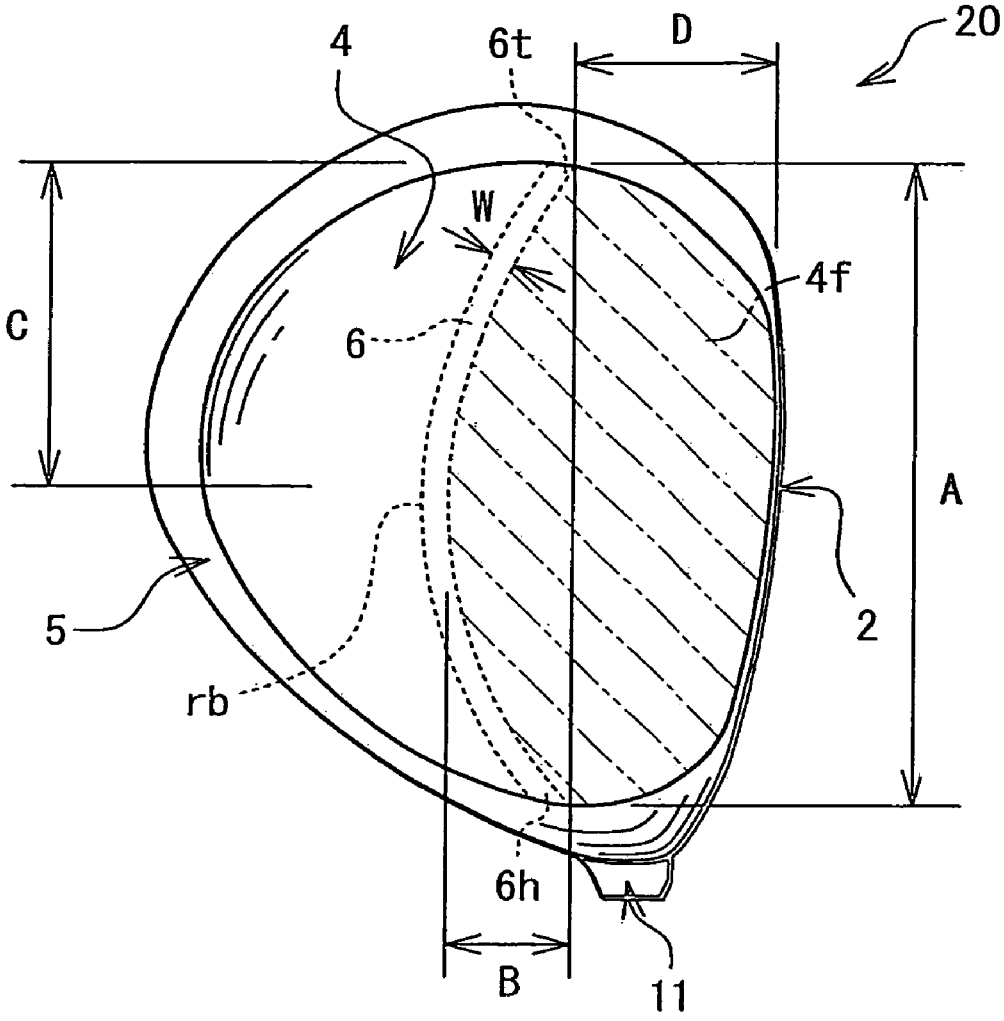
FIG. 3 is a view of a head of Example 5 as seen from a sole side.
Figure 4:
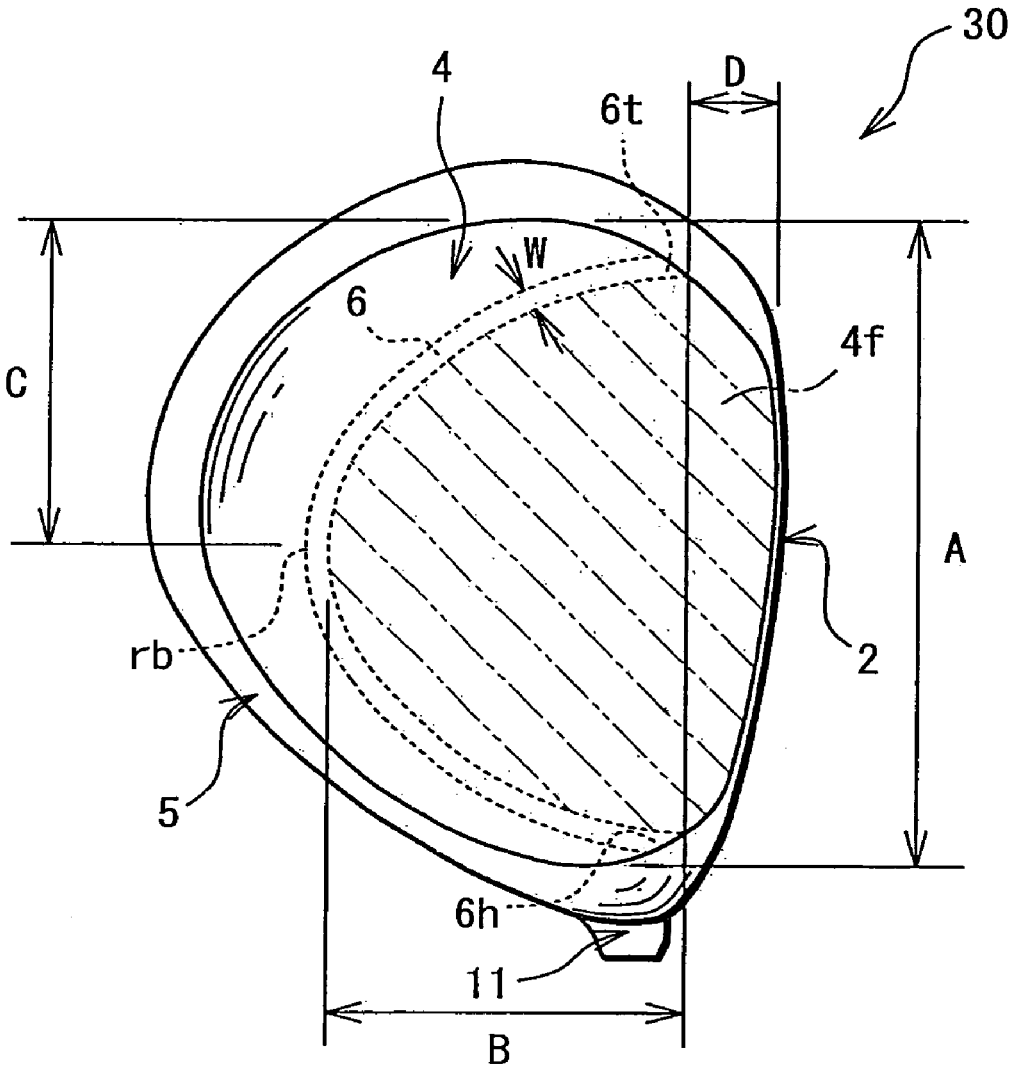
FIG. 4 is a view of a head of Example 6 as seen from a sole side.
Figure 5:
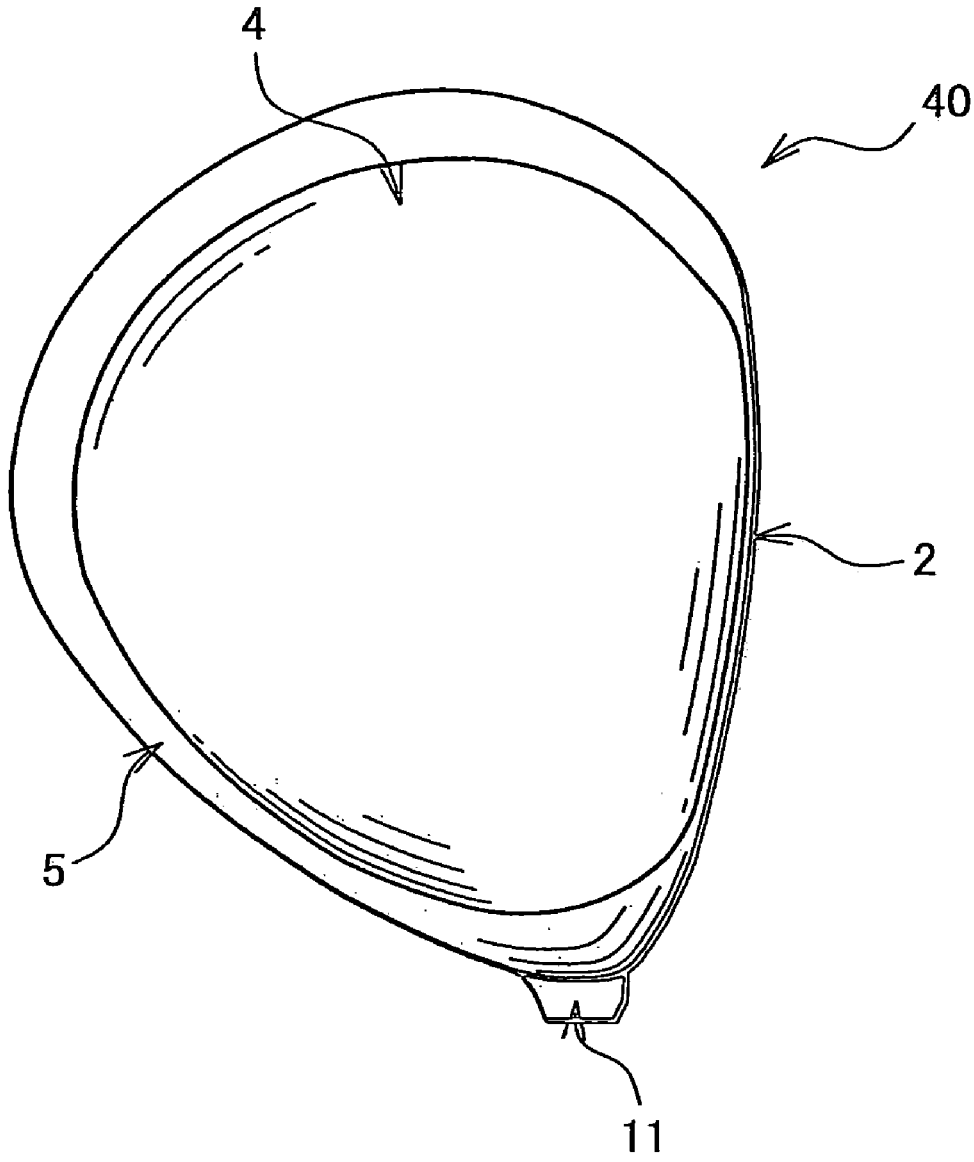
FIG. 5 is a view of a head of Comparative Example 1 as seen from a sole side.
Figure 6:
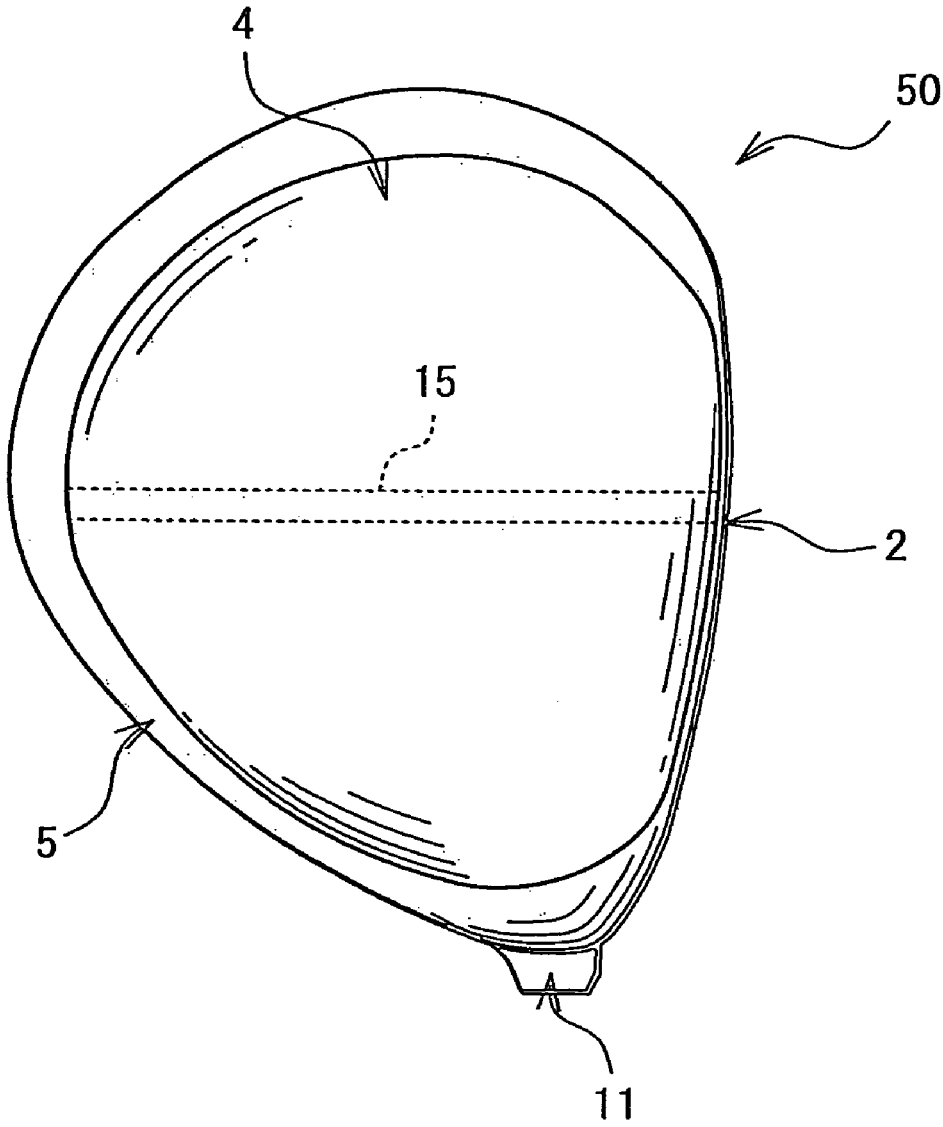
FIG. 6 is a view of a head of Comparative Example 2 as seen from a sole side.
Figure 7:
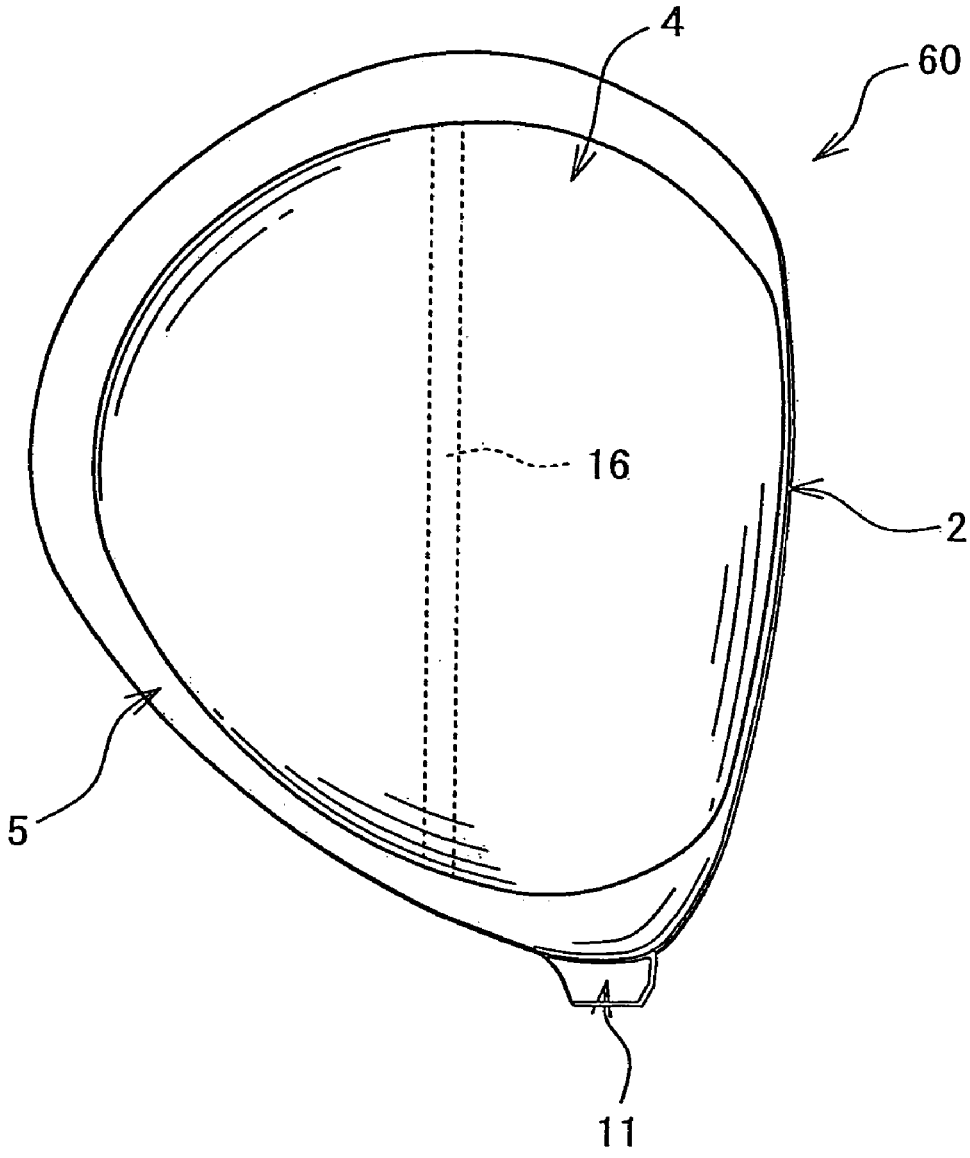
FIG. 7 is a view of a head of Comparative Example 3 as seen from a sole side.

The configurations of Examples 1 to 6 are the same as that of the forgoing embodiment. FIG. 2 schematically shows the rib layout of Examples 1 to 4. FIG. 3 schematically shows a rib layout of a head 20 of Example 5, whereas FIG. 4 schematically shows a rib layout of a head 30 of Example 6. A head 40 of Comparative Example 1, a head 50 of Comparative Example 2 and a head 60 of Comparative Example 3 are schematically shown in FIG. 5, FIG. 6 and FIG. 7, respectively. The head of Comparative Example 1 is free from the rib on the inside surface of the sole portion, as shown in FIG. 5. The head of Comparative Example 2 includes a single rib 15 located substantially centrally of the sole portion 4 with respect to the toe-heel direction and extended substantially in a straight line along the face-back direction (see FIG. 6). The head of Comparative Example 3 includes a single rib 16 located substantially centrally of the sole portion 4 with respect to the face-back direction and extended substantially in a straight line along the toe-heel direction (see FIG. 7).

The specifications and evaluation results of the individual examples are listed in Table 1 as below.

TABLE 1

| | Ex. 1 | Ex. 2 | Ex. 3 | Ex. 4 | Ex. 5 | Ex. 6 | C Ex. 1 | C Ex. 2 | C Ex. 3 |
|---|---|---|---|---|---|---|---|---|---|
| SD | FIG. 2 | FIG. 2 | FIG. 2 | FIG. 2 | FIG. 3 | FIG. 4 | FIG. 5 | FIG. 6 | FIG. 7 |
| Rib shape | Bow | Bow | Bow | Bow | Bow | Bow | — | Line | Line |
| Sole MT (mm) | 1.2 | 1.2 | 1.2 | 1.2 | 1.2 | 1.2 | 1.2 | 1.2 | 1.2 |
| B (mm) | 30 | 30 | 30 | 30 | 18 | 65 | — | — | — |
| (B/A) | 0.32 | 0.32 | 0.32 | 0.32 | 0.19 | 0.69 | — | — | — |
| (C/A) | 0.5 | 0.5 | 0.5 | 0.5 | 0.5 | 0.5 | — | — | — |
| D (mm) | 35 | 35 | 35 | 35 | 35 | 10 | — | — | 45 |
| Rib T (mm) | 1.8 | 1.4 | 2.4 | 1.8 | 1.8 | 1.8 | — | 1.8 | 1.8 |
| Rib W (mm) | 3 | 3 | 3 | 5 | 3 | 3 | — | 3 | 3 |
| Area % Of FSR | 70 | 70 | 70 | 70 | 50 | 80 | — | — | 50 |
| Max PF (Hz) | 4000 | 4000 | 5000 | 4000 | 5000 | 3150 | 3150 | 4000 | 3150 |
| SP( overall) (dB) | 123 | 125 | 121 | 122 | 117 | 125 | 130 | 115 | 120 |
| Sensory evaluation | 4.5 | 4.2 | 4.8 | 4.7 | 4.0 | 3.5 | 2.5 | 2.6 | 2.8 |

In the above table, "Rib W" means the rib width; "Max PF" means the maximum peak frequency which was measured by ⅓ octave analysis and "SP" means the sound pressure.

The individual items of the table are explained. The "SD" means the number of a schematic diagram showing each of the examples. The "Sole MT (mm)" means the mean thickness of the sole portion except for the rib. The "B", "(B/A)", "(C/A)" and "D" are defined in the foregoing. The "Rib T (thickness)" is also defined in the foregoing and hence, the rib height is obtained by subtracting 1.2 mm from the value in the above table. The "Area % of FSR" means the percentage of the area of the face side region (the area of the region 4*f* in the above embodiment) based on the overall area of the sole portion, the face side region being included in those divided by the rib provided on the inside surface of the sole portion.

In each example, a swing robot with an impact point adjusted to the face center was used to strike a teed-up ball, while measurement was taken on the impact sound. The individual examples used common balls and set a head speed to 40 m/s. The impact sounds of the individual examples were measured under the same conditions and according to the following method. The impact sound was recorded through a microphone set at place 30 cm toward the toe side from the tee. The recorded impact sound was Fourier transformed by means of an FFT analyzer and was subjected to ⅓ octave band processing. Thus, the maximum peak frequency and the sound pressure (overall value) were calculated.

Apart from the test using the swing robot, the following sensory evaluation test was conducted as follows. Ten golfers handicapped at 5 to 15 were each asked to strike balls outdoors (at a tee ground of a golf course) using golf clubs assembled with the respective heads of the examples. The golfers evaluated comfortableness of the impact sounds on a one-to-five scale (the higher score indicating the better evaluation). A mean value of the scores given by the ten golfers was calculated and is shown in the item of "Sensory evaluation" of the table. The club heads of the examples are proved to be more excellent than those of the comparative examples by the comprehensive evaluation on the maximum peak frequency and the sound pressure (overall value). That is, the club heads of the examples achieve better results than those of the comparative examples in the sensory evaluation.

What is claimed is:

1. A hollow golf club head comprising a sole portion provided with at least one rib protruding from an inside surface of the sole portion and extending from a toe side to a heel side, wherein the rib is curved in a manner that a toe-side end and a heel-side end of the rib are located closer to a face side than a central part of the rib, and wherein provided that a toe-heel width of the sole portion is A(mm), a face-back width of the rib defined between a point thereof closest to the face side and a rearmost part thereof is B(mm), and a toe-heel width between a toe-side end of the sole portion and the rearmost part of the rib is C(mm), B(mm) is in the range of 20 mm to 60 mm, (B/A) is in the range of 0.2 to 0.5 and (C/A) is in the range of 0.3 to 0.7.

2. A golf club head according to claim 1, wherein a head volume is in the range of 380 to 470 cc and a head weight is in the range of 170 to 210 g.

3. A hollow golf club head comprising a sole portion provided with at least one rib protruding from an inside surface of the sole portion and extending from a toe side to a heel side, wherein the rib is curved in a manner that a toe-side end and a heel-side end of the rib are located closer to a face side than a central part of the rib, and wherein the width of the rib is defined to be 3 mm or more whereas the thickness of the rib is defined to be 1.5 or more times the thickness of the sole portion determined at the other parts than the rib.

4. A golf club head according to claim 3, wherein the rib divides the sole portion into two or more regions, and one of the regions, which is the closest to the face side, has an area of 50% to 80% of the overall area of the sole portion.

5. A golf club head according to claim 4, wherein a head volume is in the range of 380 to 470 cc and a head weight is in the range of 170 to 210 g.

6. A golf club head according to claim 3, wherein a head volume is in the range of 380 to 470 cc and a head weight is in the range of 170 to 210 g.

7. A hollow golf club head comprising a sole portion provided with at least one rib protruding from an inside surface of the sole portion and extending from a toe side to a heel side, wherein the rib is curved in a manner that a toe-side end and a heel-side end of the rib are located closer to a face side than a central part of the rib, and wherein the rib divides the sole portion into two or more regions, and one of the regions, which is the closest to the face side, has an area of 50% to 80% of the overall area of the sole portion.

8. A golf club head according to claim 7, wherein a head volume is in the range of 380 to 470 cc and a head weight is in the range of 170 to 210 g.

9. A hollow golf club head comprising a sole portion provided with at least one rib protruding from an inside surface of the sole portion and extending from a toe side to a heel side, wherein the rib is curved in a manner that a toe-side end and a heel-side end of the rib are located closer to a face side than a central part of the rib, and wherein a face-back width D(mm) of the rib defined between a point closest to the face side and a face-side end of the sole portion is 20 mm or more, and 50 mm or less.

10. A golf club head according to any one of claims 1, 3, 7 and 9, wherein a face-back length E(mm) of the sole portion is 75 mm or more, and 105 mm or less.

* * * * *